United States Patent [19]

LeBlanc

[11] 4,433,648

[45] Feb. 28, 1984

[54] CONTROL MEANS FOR ENGINE COOLING SYSTEMS

[76] Inventor: James C. LeBlanc, 38261 Long St., Mt. Clemens, Mich. 48045

[21] Appl. No.: 158,284

[22] Filed: Jun. 10, 1980

[51] Int. Cl.[3] ..... F01P 7/02

[52] U.S. Cl. ..... 123/41.12; 123/41.49; 417/214; 60/452

[58] Field of Search ..... 123/41.08, 41.11, 41.12, 123/41.44, 41.49; 60/452; 417/212, 214, 307

[56] References Cited

U.S. PATENT DOCUMENTS

| | | | |
|---|---|---|---|
| 2,957,459 | 10/1960 | Tauschek | 123/41.12 |
| 3,211,136 | 10/1965 | Burckhardt et al. | 123/41.12 |
| 3,664,129 | 5/1972 | Schwab | 60/452 |
| 3,942,486 | 3/1976 | Kirchner | 123/41.12 |
| 3,987,624 | 10/1976 | Cooke et al. | 60/452 |
| 4,062,329 | 12/1977 | Rio | 123/41.49 |
| 4,066,047 | 1/1978 | Vidakovic et al. | 123/41.12 |
| 4,189,919 | 2/1980 | Goscenski, Jr. | 60/420 |
| 4,200,146 | 4/1980 | Olson | 165/39 |
| 4,212,164 | 7/1980 | Young | 60/452 |
| 4,223,646 | 9/1980 | Kinder | 123/41.12 |

FOREIGN PATENT DOCUMENTS 1703001 1/1979 Fed. Rep. of Germany ... 123/41.12

*Primary Examiner*—Craig R. Feinberg
*Assistant Examiner*—W. R. Wolfe
*Attorney, Agent, or Firm*—Lalos, Leeds, Keegan, Lett & Marsh

[57] ABSTRACT

In a vehicle having an engine and a cooling system for the engine including means for circulating a coolant through the engine, a fluid motor driven fan disposed in operative relation with the radiator and an engine driven pump operatively connected to the fluid motor, a means for controlling the operation of the cooling system generally consisting of a first means operatively connected to the pump and responsive to an output pressure of the pump above a first predetermined pressure for setting the output pressure of the pump at the first predetermined pressure, and second means operatively connected to the pump and responsive to an output pressure of the pump above a second predetermined pressure and a predetermined temperature of the coolant for setting the output pressure of the pump at the second predetermined pressure.

25 Claims, 5 Drawing Figures

CONTROL MEANS FOR ENGINE COOLING SYSTEMS

This invention relates a cooling system for a vehicle and more particularly to a means for controlling the operation of such a cooling system.

Many heavy duty vehicles such as military and paramilitary type personnel carriers are intended to be operated under various diverse driving conditions. Such vehicles may be required to cruise at high speeds on smooth, level grades, traverse rough terrain, climb steep grades and tow other heavy vehicles. Usually, such vehicles are equipped with high horsepower gasoline or diesel engines and, often, with automatic transmissions. When the engines of such vehicles are operated in a low speed, high torque mode, the engines and, where used, the automatic transmissions generate a substantial quantity of heat which must be dissipated by the cooling system to provide for proper operation of the engines.

Typically, such vehicles are provided with radiators through which engine coolant is circulated in heat exchange relation with a stream of air provided by a fan mounted either on the engine and driven directly by the engine or remotely and driven by the engine through a hydraulic drive system. In either type of arrangement, the power for operating the cooling fan is provided by the engine which has the effect of reducing the horespower of the engine delivered to the wheels.

When such vehicles are operated in a towing or climbing mode, involving a low speed, high torque condition, a maximum amount of heat is generated by the engine and, where employed, the automatic transmission. To provide for the dissipation of such large amount of heat energy, it has been the conventional practice in the prior art to provide large, high horsepower consuming cooling fans. Such systems have been known to consume up to 20% of the total horsepower produced by the engine.

In many vehicles, such large cooling fans are operated at a constant high speed during all modes of operation, thus producing a constant drain of horsepower on the engine. More recently, there has been developed the practice of providing for the disengagement of the fan from the engine drive during high speed, low torque operations of the engine, when less heat is being generated by the engine and transmission, to reduce the horsepower drain on the engine. In the use of remotely mounted fans, certain control systems have been developed for varying the speed of the cooling fan and correspondingly the energy drain on the engine by varying the output of an engine driven variable displacement pump which is responsive to coolant temperature variations. Such type of system, however, has been found to be not only complex in design and operation, but also comparatively expensive to manufacture. It thus has been found to be desirable to provide a control means for a remotely operated cooling fan of a vehicle which will provide adequate cooling of the engine during all modes of operation, consistent with a minimal horsepower consumption, which is simple in design and economical to manufacture.

Accordingly, it is the principal object of the present invention to provide a novel control arrangement for the cooling system of a vehicle.

Another object of the present invention is to provide a novel control arrangement for the cooling system of a vehicle which requires a reduced amount of horsepower for operating the cooling system.

A further object of the present invention is to provide a novel control arrangement for the cooling system of a vehicle which minimizes the horsepower drain on the engine of the vehicle used to operate the cooling system.

A still further object of the present invention is to provide a novel control arrangement for the cooling system of a vehicle which provides for the efficient operation of such a cooling system.

Another object of the present invention is to provide a novel control arrangement for the cooling system of a vehicle adapted to be operated in various drive modes including cruising on roadways, traversing rough terrain, climbing steep grades and towing other vehicles, which provides for minimal drain of horsepower on the engine of the vehicle during all such modes of operation.

A further object of the present invention is to provide a control arrangement for the cooling system of a vehicle equipped with a high horsepower gasoline or diesel internal combustion engine and possibly an automatic transmission.

A still further object of the present invention is to provide a novel control arrangement for the cooling system of a vehicle which provides for an efficient operation of such cooling system during high speed, low torque or low speed, high torque operating conditions of the vehicle.

Another object of the present invention is to provide a novel control arrangement for the cooling system of a vehicle which is comparatively simple in design, relatively inexpensive to manufacture, and highly reliable and effective in performance.

Other objects and advantages of the present invention will become more apparent to those persons having ordinary skill in the art to which the present invention pertains from the following description taken in conjunction with the accompanying drawings wherein.

Figure 1:
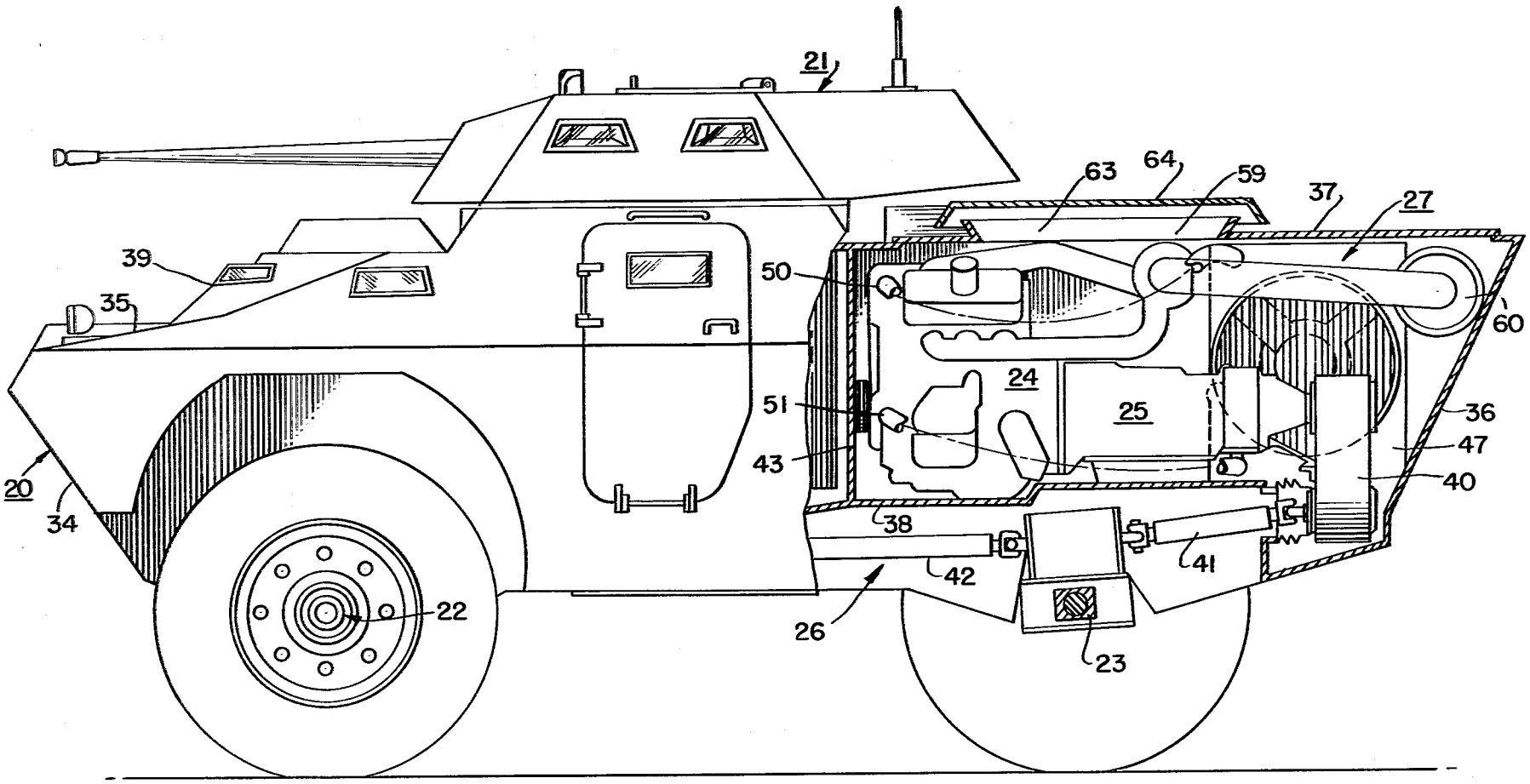
FIG. 1 is a side-elevational view of a military or paramilitary type vehicle utilizing an embodiment of the present invention, having a portion thereof broken away to illustrate the engine compartment of the vehicle.

Referring to the drawings, there is illustrated a vehicle having a cooling system embodying the present invention. Generally, the vehicle includes a hull 20, a weapons system 21 mounted on the hull, front and rear axle assemblies 22 and 23 provided with wheels, tires and brake systems, front and rear suspension systems, an engine 24, a transmission 25, a drive line 26, a cooling system 27 provided with a control arrangement 28, a driver's station provided with a steering system and various engine, transmission and drive control systems and additional auxiliary systems.

Figure 2:
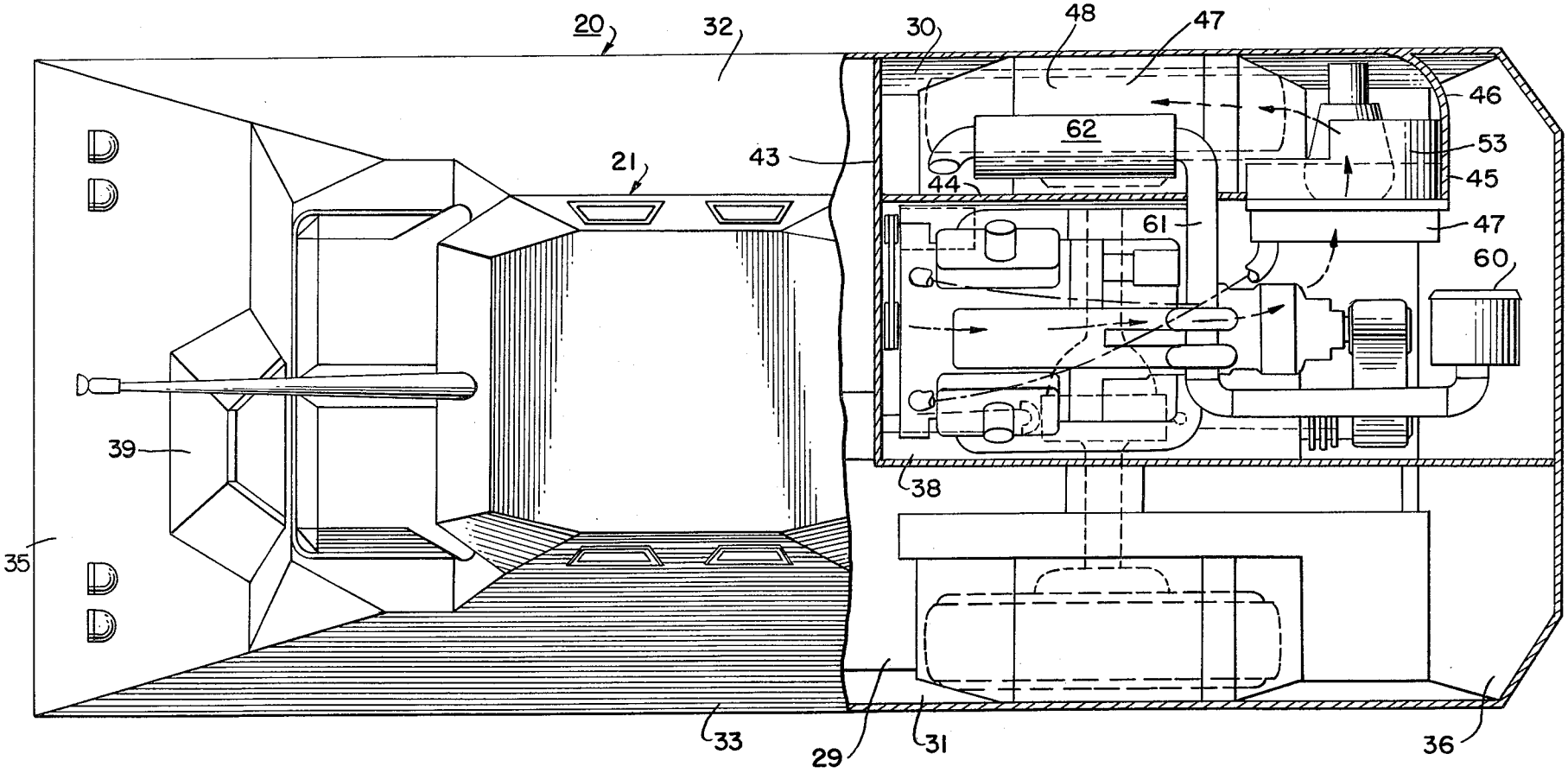
FIG. 2 is a top plan view of the vehicle shown in FIG. 1, also having a portion thereof broken away to illustrate the engine compartment of the vehicle.

As best illustrated in FIGS. 1 and 2, the hull is of a monocoque or unitized construction, formed of armor or abrasion resistant steel panels, welded together. Generally, the hull includes a bottom or floor section 29, lower sidewall sections 30 and 31, upper sidewall sections 32 and 33, a lower front wall section 34, an upper front wall or hood section 35, a rear wall section 36 and a top or roof section 37. Mounted on floor section 29 is a drive line housing 38, offset slightly from the longitudinal center line of the vehicle. The lower portions of the forward and rear ends of the drive line housing are open to accommodate the axle assemblies.

Lower sidewall sections 30 and 31 are welded adjacent their lower edges to floor section 29 and project outwardly and upwardly at an angle to the floor section. Similarly, lower front wall section 34 and rear wall section 36 are welded adjacent their lower edges to floor section 29 and project upwardly and outwardly at angles to the floor section. The side edges of lower front wall section 35 and rear end wall section 36 also are welded to lower side sections 30 and 31. Upper sidewall sections 32 and 33 are welded along their lower edges to the upper edges of lower sidewall sections 30 and 31 and project inwardly and upwardly at an angle to the lower sidewall sections. The rear edges of the upper sidewall sections also are welded to the upper side edges of rear end wall section 36.

The front end of the hull is closed by the upper front wall or hood section 35 which includes a vision shock arrangement 39. The front and side edges of the hood section are welded to the lower front end section 34 and also to the sidewall sections of the vehicle. The upper end or roof section 37 is substantially flat or horizontal and is provided with a forwardly disposed raised portion on which the weapon system is mounted. Otherwise, the roof section is welded about its periphery to the upper edges of upper side-wall sections 32 and 33, hood section 35 and rear end wall section 36.

As best seen in FIG. 2, portions of the floor section and adjacent portions of the lower wall sections are cut away and provided with housing assemblies defining front and rear wells for accommodating the wheels of the vehicle. The wheel well housings also are formed of panels of armor steel welded together and are integral parts of the vehicle hull.

Axle assemblies 22 and 23 are conventional, hypoid, single-speed, double-reduction type assemblies of the type used extensively by the U.S. military. Such assemblies are of the "top drive" type utilizing locking or no spin differentials. The brake systems mounted on the axles are of the internal expanding type provided with hydraulic power boosters. The wheels mounted on the axles are of a conventional type having disc and rim components. The tires are of a "run flat" type, i.e., having reinforced sidewalls to permit limited running when the tires have been punctured. Such tires further are provided with deep recesses in the treads thereof which are effective to propel the vehicle at low speeds when the vehicle hull is afloat and the wheels are spinning. The upper ends of the wheels are received within the wheel well housings, as best illustrated in FIGS. 1 and 2.

The suspension systems are of a conventional, truck-type design generally including heavy duty leaf springs operatively connected to the underside of the hull by pins and shackles and supported on the axle housings, U-bolts and retainer plates for securing the springs to the axle housings and conventional shock absorbers operatively interconnecting the hull and the axle housings. The axle and suspension assemblies are mounted on the exterior of the hull.

Engine 24 may consist of either a diesel or gas engine. The engine shown is a two-cycle, V-6 turbocharged diesel engine provided with a fuel injection system. As best illustrated in FIGS. 1 and 2, the engine is mounted within the hull between the axle assemblies, just forward of the rear axle and to the right of the longitudinal center line of the hull adjacent the right sidewall of the hull. Mounted on the hull directly behind the engine is transmission 25. The transmission is an automatic, five-speed transmission.

Drive line 26 which transmits torque from the transmission to the differentials of the axles includes a drive chain assembly 40, a rearwardly disposed propeller shaft 41, an intermediate propeller shaft 42, a disconnect clutch and a forwardly disposed propeller shaft. Drive chain assembly 40 is mounted on the transmission housing and functions to transmit drive from the transmission output shaft downwardly and toward the longitudinal center line of the vehicle. Rearwardly disposed propeller shaft 41 is operatively connected at opposite ends with universal joints to the lower end of the chain drive assembly and rear axle assembly 23, and functions to transmit drive from the lower end of the drive chain assembly to the rear axle. Intermediate propeller shaft 42 is operatively connected at opposite ends thereof through universal joints to rear axle assembly 23 and the disconnect clutch, and functions to transmit drive from the rear axle to the disconnect clutch. Similarly, the forwardly disposed propeller shaft is operatively connected at opposite ends thereof through universal joints to the disconnect clutch and axle assembly 22, and functions to transmit drive from the disconnect clutch to front axle assembly 22.

Referring to FIG. 2, the interior of the vehicle hull is provided with a transversely disposed partition wall 43 disposed immediately forwardly of the engine. Extending rearwardly from partition wall 43, along the engine, is a partition wall 44 which extends almost to the rear of the vehicle. Extending laterally from the rear end of partition wall 44 is a partition wall 45 having a forwardly curved portion 46 engaging the sidewall of the hull. A radiator 47 of the cooling system for the vehicle is mounted on the hull across an opening in partition wall 44. As best seen in FIG. 2, interior partition walls 43, 44 and 45, the floor, the wheel well housing, sidewall and roof sections of the hull and radiator 47 form a plenum chamber 48 disposed substantially between the engine and a sidewall of the hull. The forward end of the plenum chamber communicates with the exterior of the vehicle through an exhaust opening in the roof section of the hull. Gases expelled through the exhaust opening are diverted upwardly and laterally by a baffle 49 mounted on the roof section of the hull.

Radiator 47 is of a conventional construction and is connected to the coolant circulating system of the engine through a pair of hoses 50 and 51. Mounted at the rear end of partition wall 44 adjacent radiator 47 is a fan assembly 52 which functions to draw air from the interior of the hull including the engine and the radiator, and expel such air through plenum chamber 48, the exhaust opening and baffle 49 into the atmosphere.

Figure 3:
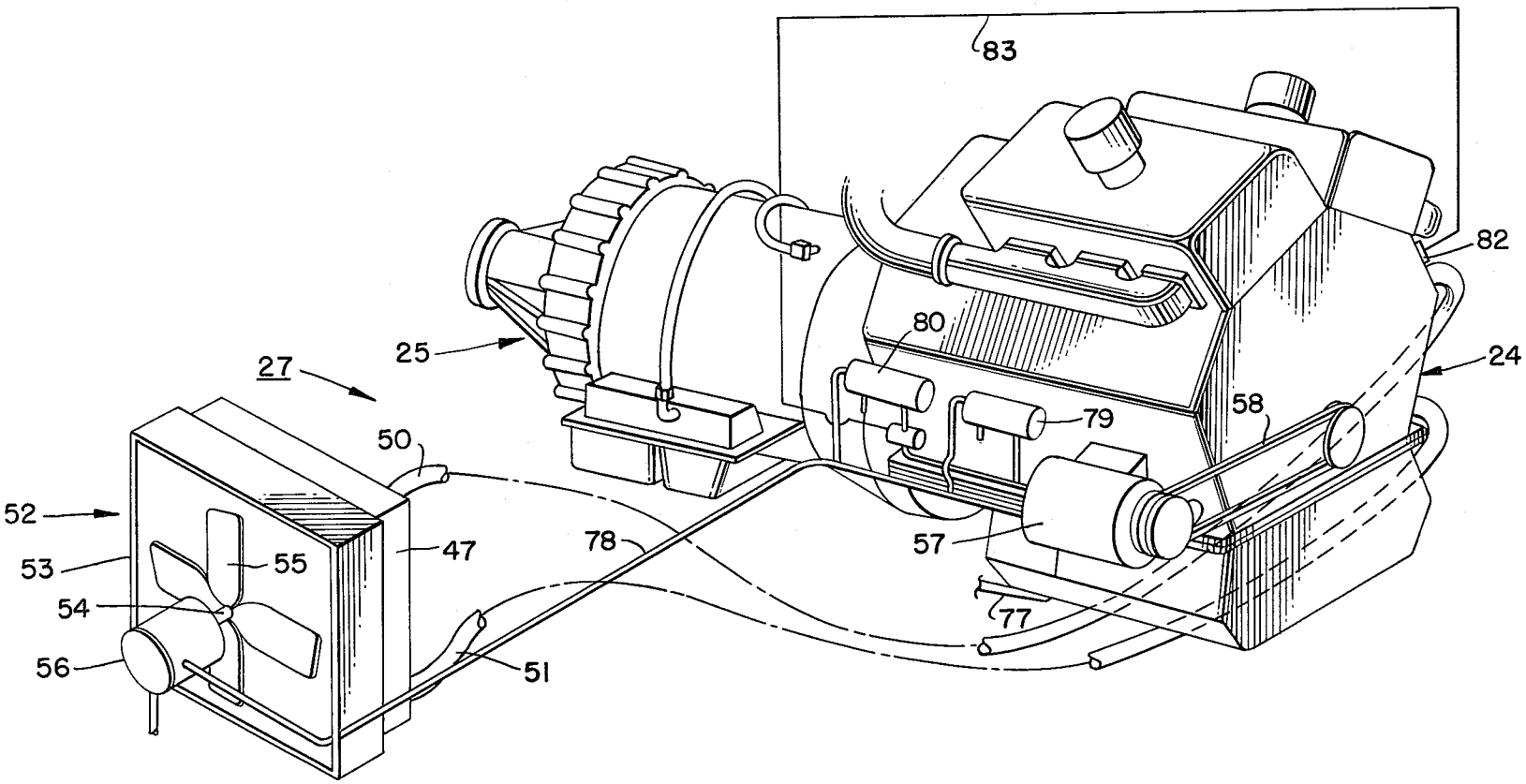
FIG. 3 is a perspective view of the engine, transmission and cooling system of the vehicle shown in FIGS. 1 and 2, and components of the control arrangement for the cooling system, comprising the present invention, shown diagrammatically.
Figure 4:
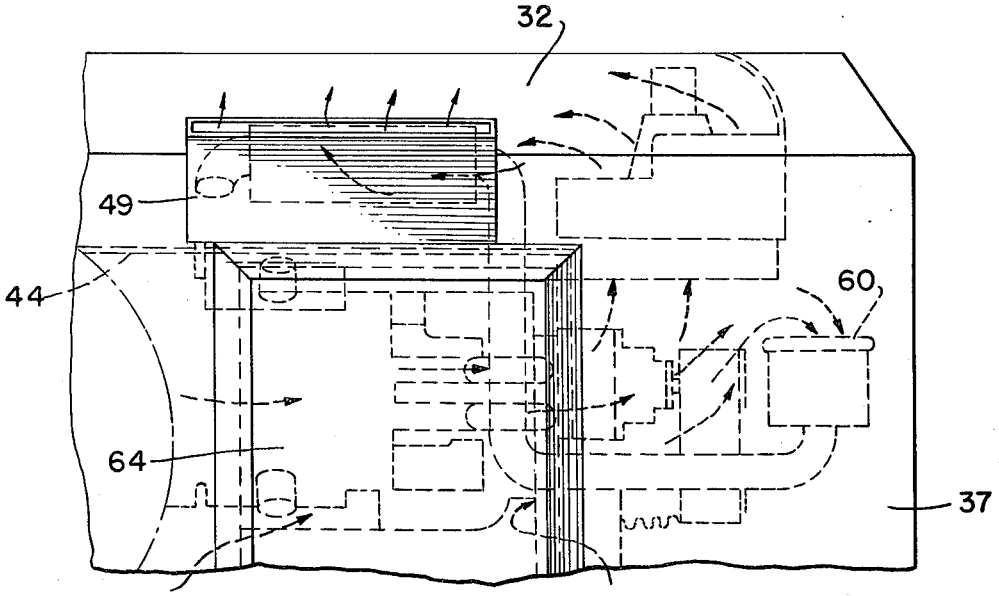
FIG. 4 is a fragmentary, top plan view of the vehicle shown in FIGS. 1 and 2, illustrating a portion of the exhaust system of the vehicle.

The fan assembly is best illustrated in FIG. 3 and consists of a shroud 53 mounted on the rear end of partition wall 44 about the opening therein, a housing mounted coaxially relative to the shroud and supported therein by several radially disposed struts, an impeller shaft 54 journaled in the support housing, an impeller 55 mounted on the front end of shaft 54 adjacent the opening in partition wall 44, and a fluid motor 56 mounted on the outer end of the support housing and operatively connected to impeller shaft 54. Fluid motor 56 is operated by a variable displacement, piston type pump 57 mounted on the engine and driven by the crankshaft of the engine by a belt drive 58.

Air is drawn by the fan assembly from the interior of the entire vehicle, thus providing a certain amount of ventilation and removing smoke and other noxious gases, which results in greater comfort to operating personnel. Air also is drawn from the exterior of the hull through an inlet opening 59 provided in roof section 37, above the engine, which passes along the engine and transmission to the radiator. A portion of such air is drawn through an air inlet member 60 of the turbocharger assembly of the engine. Air expelled by the fan assembly through plenum chamber 48 also passes in heat exchange contact with an exhaust pipe 61 and muffler 62 of the engine, located in the front end of plenum chamber 48. With such an arrangement, exhaust gases emanating from exhaust pipe 61 will become entrained in the air propelled through the plenum chamber by the fan assembly and expelled into the atmosphere. The entry of foreign matter through inlet opening 59 is prevented by an arrangement of components including an upwardly opening duct 63 mounted on roof section 37 about the periphery of air inlet 59, and a cover member 64 mounted on the roof section and spaced above the upper end of duct 63 to permit air from the atmosphere to be drawn between duct 63 and cover 64 and passed downwardly through inlet 59 into the interior of the hull.

Whenever the cooling system of the vehicle is operated, air will be drawn through air inlet 59 and from the interior of the entire vehicle, through the radiator and plenum chamber and be expelled outwardly through the exhaust opening and baffle 49 into the atmosphere. As the air passes along the engine and transmission to the radiator, it will have a cooling effect on both the engine and transmission.

Pump 57 is of a conventional, variable displacement, piston type and generally includes a housing 65, an input shaft 66 journaled in the housing, a rotating plate 67 mounted on input shaft 66 and provided with a plurality of piston chambers 68 communicable with inlet and outlet passageways 69 and 70 in the housing, a variable angle yoke 71 mounted on the input shaft, a plurality of pistons 72 mounted on the yoke and reciprocable in chambers 68, and a yoke stroking piston 73 shiftable in a piston chamber 74 and engageable with yoke 71. One side of the yoke is urged into engagement with the inner end of stroking piston 73 by means of a spring 75. Fluid inlet passageway 69 is connected to an oil reservoir 76 by means of a fluid line 77. Outlet passageway 70 is connected to fan motor 56 by means of a fluid supply line 78.

Figure 5:
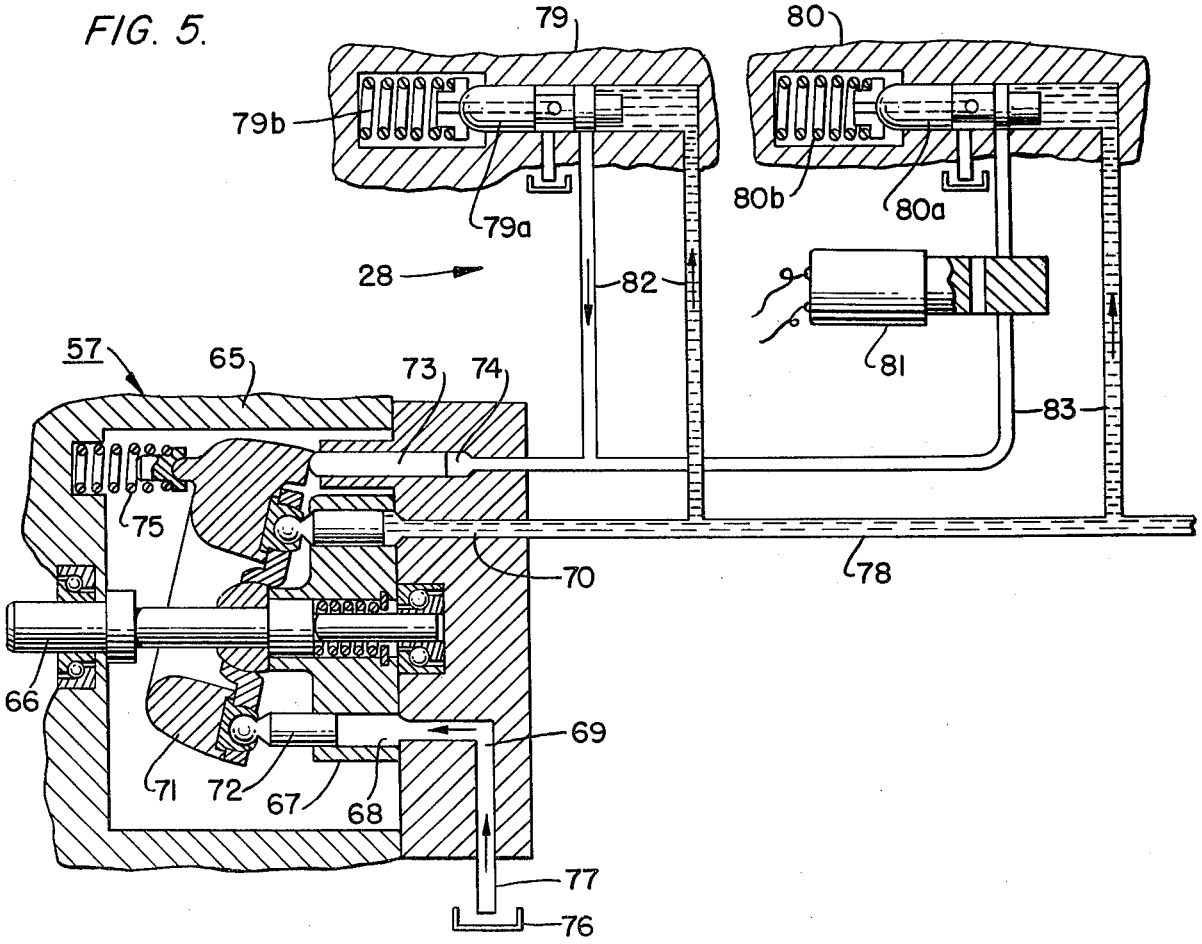
FIG. 5 is a diagrammatic view of the cooling system control means for the vehicle shown in FIGS. 1 through 4, comprising an embodiment of the present invention.

The displacement of pump 57 and, correspondingly, the pressure of the fluid supplied to fan motor 56 is controlled by control means 28 which includes pressure compensating valves 79 and 80 and a solenoid actuated cutoff valve 81. As best shown in FIGS. 3 and 5, valve 79 is provided in a fluid line 82 intercommunicating fluid supply line 78 and stroking piston chamber 74. Similarly, valve 80 is provided in a fluid line 83 intercommunicating fluid supply line 78 and stroking piston chamber 74. Valve 79 is of a conventional type having a valve element 79*a* urged into a closed position by a spring 79*b*. Whenever the pressure in fluid supply line 78 exceeds the force exerted by the spring 79*b*, the valve element will move to the left relative to FIG. 5, against the biasing action of spring 79*b*, to supply fluid under line pressure to stroking piston chamber 74. Similarly, valve 80 is of a conventional type including a valve element 80*a* urged into a closed position by a spring 80*b*. Whenever the pressure in fluid supply line 78 exceeds the force, exerted by spring 80*b*, valve element 80*a* will be caused to shift to the left relative to FIG. 5, against the biasing action of spring 80*b*, to supply fluid under line pressure to stroking piston chamber 74.

By proper selection of the spring rates of springs 79*b* and 80*b*, valves 79 and 80 will operate to communicate the stroking piston chamber with different predetermined line pressures. As either of the valves opens to communicate stroking piston chambers 74 with supply line pressure, such line pressure will cause stroking piston 73 to shift thus altering the displacement of the pump and the output pressure of the pump until the output pressure of the pump corresponds to the setting of the spring in the valve performing the control function. In accordance with the present invention, valve 79 is set at a predetermined lower pressure and valve 80 is set at a predetermined higher pressure. In practice, for one application, valve 79 is set to open at 1500 psi and valve 80 is set to open at 3000 psi.

Solenoid actuated cutoff valve 81 normally is adapted to be in a closed position as shown in FIG. 5. The solenoid portion of the valve is energized by means of a thermal sensing element 82 positioned at an outlet of the coolant circulating system of the engine, and connected to the solenoid portion of the valve by means of an electrical wire 83. Whenever the thermal sensing element senses a predetermined temperature of the engine coolant, it functions to energize the solenoid portion of valve 81 to shift the spool of the valve and permit flow through fluid line 83. In practice, for purposes of illustration, a thermal sensing element may be utilized to energize the solenoid portion of the cutoff valve whenever the engine coolant reaches a temperature of 220° F.

The function of the cooling system control means as described is to supply fluid under a comparatively lower pressure to the fan motor when the engine is operating under a high speed, low torque condition, to operate the fan at a comparatively lower speed, and to supply fluid under a comparatively higher pressure to the fan motor when the engine is operating under a lower speed, high torque condition, to operate the fan at a comparatively higher speed. Under such conditions, when the engine is operating under low speed, high torque conditions, as when it is climbing a steep grade or towing a vehicle, and a substantial portion of the energy of the engine is being converted into heat, the fan will operate at a comparatively higher rpm to adequately cool the engine. When the engine is operating under high speed, low torque conditions, as when the vehicle is cruising along a roadway, and comparatively less energy of the engine is being converted into heat, the fan will operate at a comparatively lower speed thus consuming less horsepower of the engine.

In the operation of the embodiment shown in the drawings, assuming valve 79 is set to open at 1500 psi, valve 80 is set to open at 3300 psi and cutoff valve 81 is adaped to open whenever the thermal sensing element senses an engine coolant temperature of 220° F., while the vehicle is cruising along a highway under a comparatively high speed and low torque condition, pump 57 will operate to supply fluid under pressure to the fan motor. Whenever the pressure of such fluid exceeds the 1500 psi, the setting of valve 79, valve 79 will open to apply such excessive pressure to yoke stroking piston chamber 74. Such pressure then causes stroking piston 73 to shift and thus limit the displacement of the pump and result in a lower pressure output of the pump.

Assuming next that the vehicle begins climbing a steep grade or that the vehicle begins towing another heavy vehicle so that the engine is operating under a low speed, high torque condition, causing the engine and transmission to generate a greater amount of heat, the rpm of the fluid pump will increase to drive the fan faster, up to 4000 rpm, and the temperature of the engine coolant also will be caused to increase. Under such circumstances, as soon as line pressure exceeds 3300 psi, the setting of valve 80, and the temperature of the coolant reaches 220° F., corresponding to the activation value of the thermal sensing element, valves 80 and 81 will open to supply fluid under line pressure to stroking piston chamber 74. Such increase in pressure in chamber 74 will cause stroking piston 73 to shift to the left relative to FIG. 5, thus decreasing the displacement of the pump and correspondingly decreasing line pressure to 3300 psi.

Whenever the vehicle is taken out of the low speed, high torque mode, and the coolant temperature falls below 220° F., valve 81 will close so that valve 80 becomes inoperative and the pump again is operated at 1500 psi by valve 79. Upon closure of cutoff valve 81, if the line pressure exceeds 1500 psi, valve 79 will open to pressurize stroking valve chamber 74 to cause the stroking piston to shift and thus decrease the displacement of the pump. Eventually, line pressure will decrease to about 1500 psi which is sufficient to operate the cooling fan at the proper speed to cool the engine and transmission. As the displacement of the pump decreases, the horsepower drain on the engine correspondingly will be decreased, thus increasing the efficiency of the engine.

In essence, the control arrangement functions to automatically increase the cooling fan speed during low speed, high torque operation of the engine when the engine is converting a large portion of its energy into heat, and to decrease the speed of the cooling fan when the engine is in a high speed, low torque operating condition, sufficiently to adequately cool the engine and transmission yet not excessively so as to cause an undue horsepower drain on the engine and thus decrease the operating efficiency of the engine.

In the use of a 300 horsepower diesel engine and an automatic transmission in a vehicle of the type described, a pump for cooling such an engine normally would operate at a pressure in excess of 3300 psi at all times, consuming an estimated engine horsepower of in excess of 60 horsepower, i.e., approximately in excess of 20% of the total horsepower output of the engine. With the control arrangement as described, during low speed, high torque operating conditions of the engine, the system pressure will be limited to 3300 psi, providing a fan motor horsepower of 48. Under such circumstances, the fan will operate at approximately 4300 rpm to produce an air flow rate of approximately 14,000 cubic feet per minute. Also under such conditions, the consumption of engine horsepower will be approximately 60 horsepower or limited to 20% of the total engine horsepower output. However, when the engine is in the high speed, low torque operating condition, the system pressure will be limited to 1500 psi to provide a fan motor horsepower of only 17 horsepower. Under such circumstances, the fan will operate at 3000 rpm to provide an air flow rate of approximately 10,500 cubic feet per minute which would be sufficient to cool the engine and transmission. Furthermore, the consumption of engine horsepower would be only about 20 horsepower, approximately 7% of the total engine horsepower output.

Pressure compensating valves 79 and 80 and solenoid actuated cutoff valve 81 have been illustrated and described as components apart from the variable displacement, piston type pump. However, in the contemplated commercial application of the invention, such components would be constructed integrally with the pump so that a single unit would be provided for mounting on the pump to provide the control functions as described. In this regard, it will be appreciated that such a unit and the fluid lines thereof and the thermosensing element provide a comparatively simple package which can easily be installed in a vehicle of the type described to provide for a greater efficiency of engine operation while still providing an adequate cooling of the engine and transmission during all modes of operation.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. In a vehicle having an internal combustion engine and a cooling system for said engine including means for circulating a coolant through said engine, a radiator operatively connected to said coolant circulating means, a fluid motor driven fan disposed in operative relation with said radiator and an engine driven variable displacement, piston type pump provided with an input shaft, a variable angle yoke mounted on said input shaft, a yoke stroking piston shiftable in a chamber and having an outer end engageable with said variable angle yoke and means for biasing said variable angle yoke against the end portion of said yoke stroking piston, and having a fluid supply line operatively connected to said fluid motor, a means for controlling the operation of said cooling system comprising a first fluid line interconnecting said fluid supply line and said yoke stroking piston chamber of said pump, said first fluid line having a pressure compensating valve operable to open in response to an output pressure of said pump above a first predetermined pressure of said fluid supply line for shifting said stroking piston to vary the angle of said yoke and correspondingly vary the displacement of said pump to provide a pump output pressure corresponding to said first predetermined pressure, a second fluid line intercommunicating said fluid supply line and said stroking piston chamber of said pump, said second fluid line having a pressure compensating valve operable to open in response to a pump output pressure of said valve above a second predetermined pressure for shifting said stroking piston to vary the displacement of said pump and correspondingly provide a pump output pressure corresponding to said second predetermined pressure, and said second fluid line having a cutoff valve normally disposed in a closed condition, operable responsive to a predetermined temperature of said coolant for opening.

2. In a vehicle having an engine and a cooling system for said engine including means for circulating a coolant through said engine, a fluid motor driven fan disposed in operative relation with a radiator and an engine driven pump operatively connected to said fluid motor, a means for controlling the operation of said cooling system comprising a first pressure compensating valve operatively connected to said pump and responsive to an output pressure of said pump above a first predetermined pressure for setting the output pressure of said pump at said first predetermined pressure, and second pressure compensating valve operatively connected to said pump and responsive to an output pressure of said pump above a second predetermined pressure and a predetermined temperature of said coolant for setting the output pressure of said pump at said second predetermined pressure.

3. A cooling system control means according to claim 2 wherein said second predetermined pressure is higher than said first predetermined pressure.

4. A cooling system control means according to claim 3 wherein said predetermined temperature is 220° F.

5. A cooling system control means according to claim 2 wherein said first predetermined pressure is 1500 psi and said second predetermined pressure is 3300 psi.

6. A cooling system control means according to claim 5 wherein said predetermined temperature is 220° F.

7. In a vehicle having an internal combustion engine and a cooling system for said engine including means for circulating a coolant through said engine, a radiator operatively connected to said coolant circulating means, a fluid motor drive fan disposed in operative relation with said radiator and an engine driven variable displacement, piston type pump provided with a yoke stroking piston, operatively connected to said fluid motor by means of a fluid supply line, a means for controlling the operation of said cooling system comprising a first fluid line intercommunicating said fluid supply line and a chamber of said yoke stroking piston of said pump, having a pressure compensating valve operable to open in response to a first predetermined pressure of said fluid supply line, a second fluid line intercommunicating said fluid supply line and said stroking piston chamber of said pump, having a pressure compensating valve operable to open in response to a second predetermined pressure of said fluid supply line, and said second fluid line having a cutoff valve normally disposed in a closed condition, operable responsive to a predetermined temperature of said coolant for opening.

8. A cooling system control means according to claim 7 wherein said cutoff valve in said first fluid line is solenoid actuated.

9. A cooling system control means according to claim 7 wherein said second predetermined pressure is higher than said first predetermined pressure.

10. A cooling system control means according to claim 9 wherein said predetermined temperature is 220° F.

11. A cooling system control means according to claim 7 wherein said first predetermined pressure is 1500 psi and said second predetermined pressure is 3300 psi.

12. A cooling system control means according to claim 11 wherein said predetermined temperature is 220° F.

13. A cooling system control means according to claim 7 wherein said cutoff valve is a solenoid actuated valve, controlled by a thermal sensing device.

14. A cooling system control means according to claim 13 wherein said thermal sensing device is positioned in an outlet portion of said engine coolant circulating means.

15. A cooling system control means according to claim 14 wherein said thermal sensing device is operable to energize said solenoid actuated valve responsive to a coolant temperature of 220° F.

16. In a vehicle having an engine and a cooling system for said engine comprising:

means for circulating a coolant through said engine, a fluid motor drive fan disposed in operative relation with a radiator and an engine driven pump operatively connected to said fluid motor, said pump being a variable displacement pump, means for controlling the operation of said cooling system including a first pressure adjusting means operatively connected to said pump and responsive to an output pressure of said pump above a first predetermined pressure for varying the displacement and adjusting the output pressure of said pump to said fan at said first predetermined pressure to provide a normal cooling mode at a substantially constant fan speed, and second pressure adjusting means operatively connected to said pump and responsive to an output pressure of said pump above a second predetermined pressure and a predetermined temperature of said coolant for varying the displacement and adjusting the output pressure of said pump to said fan at said second predetermined pressure to provide a higher cooling mode at a higher fan speed than at said normal mode.

17. A cooling system control means according to claim 16 wherein said second pressure setting means includes a cutoff valve.

18. A cooling system control means according to claim 16 wherein said second pressure setting means includes a solenoid actuated valve.

19. A cooling system control means according to claim 16 wherein said second predetermined pressure is higher than said first predetermined pressure.

20. A cooling system control means according to claim 19 wherein said predetermined temperature is 220° F.

21. A cooling system control means according to claim 16 wherein said first predetermined pressure is 1500 psi and said second predetermined pressure is 3300 psi.

22. A cooling system control means according to claim 21 wherein said predetermined temperature is 220° F.

23. A cooling system control means according to claim 16 wherein said second pressure setting means includes a solenoid operable valve, controlled by a thermal sensing device.

24. A cooling system control means according to claim 23 wherein said thermal sensing device includes a thermocouple positioned in an outlet of said engine coolant circulating means.

25. A cooling system control means according to claim 24 wherein said thermocouple is operative in sensing a coolant temperature of 220° F.

* * * * *